US008409493B2

(12) United States Patent
Schlienger et al.

(10) Patent No.: US 8,409,493 B2
(45) Date of Patent: Apr. 2, 2013

(54) SYSTEMS AND METHODS FOR LEACHING A MATERIAL FROM AN OBJECT

(75) Inventors: Max Eric Schlienger, Napa, CA (US); Michael Dean Baldwin, Napa, CA (US); Michael Christopher Maguire, Napa, CA (US)

(73) Assignee: Rolls-Royce Corporation, Indianapolis, IN (US)

( * ) Notice: Subject to any disclaimer, the term of this patent is extended or adjusted under 35 U.S.C. 154(b) by 56 days.

(21) Appl. No.: 12/852,231

(22) Filed: Aug. 6, 2010

(65) Prior Publication Data

US 2011/0048172 A1 Mar. 3, 2011

Related U.S. Application Data

(60) Provisional application No. 61/231,827, filed on Aug. 6, 2009.

(51) Int. Cl.
*C22B 3/02* (2006.01)

(52) U.S. Cl. ..... 266/88; 266/89; 266/101

(58) Field of Classification Search ..... 266/101, 266/89, 88

See application file for complete search history.

(56) References Cited

U.S. PATENT DOCUMENTS

| | | | | |
|---|---|---|---|---|
| 3,563,711 | A | 2/1971 | Hammond et al. | |
| 3,698,467 | A | 10/1972 | Fassler et al. | |
| 4,134,777 | A | 1/1979 | Borom | |
| 4,141,781 | A | 2/1979 | Greskovich et al. | |
| 4,552,198 | A | 11/1985 | Mills et al. | |
| 4,995,443 | A | 2/1991 | Easwaran | |
| 5,268,036 | A | 12/1993 | Neubauer et al. | |
| 5,332,023 | A | 7/1994 | Mills | |
| 5,685,917 | A | 11/1997 | Sangeeta | |
| 5,779,809 | A | 7/1998 | Sangeeta | |
| 6,099,655 | A | 8/2000 | Farr et al. | |
| 6,354,310 | B1 | 3/2002 | Farr et al. | |
| 6,672,367 | B2 | 1/2004 | Crafton et al. | |
| 6,739,380 | B2 * | 5/2004 | Schlienger et al. | 164/131 |
| 6,910,522 | B2 | 6/2005 | Crafton et al. | |
| 6,945,262 | B2 | 9/2005 | Farr et al. | |
| 7,037,381 | B2 | 5/2006 | Farr et al. | |
| 7,038,180 | B2 | 5/2006 | Snop | |
| 2002/0084052 | A1 | 7/2002 | Crafton et al. | |
| 2004/0003909 | A1 | 1/2004 | Schlienger et al. | |
| 2004/0154641 | A1 | 8/2004 | Montierth | |
| 2005/0022957 | A1 | 2/2005 | Crafton et al. | |
| 2005/0145362 | A1 | 7/2005 | Crafton et al. | |
| 2005/0189347 | A1 | 9/2005 | Snop | |
| 2005/0268942 | A1 | 12/2005 | Farr et al. | |
| 2006/0054294 | A1 | 3/2006 | Crafton et al. | |
| 2009/0050286 | A1 | 2/2009 | Bewlay et al. | |

OTHER PUBLICATIONS

Accumulator. Dictionary.com Unabridged. Retrieved Feb. 14, 2012, from Dictionary.com website: http://dictionary.reference.com/browse/accumulator.*

Acoustic. (n.d.). Dictionary.com Unabridged. Retrieved Feb. 14, 2012, from Dictionary.com website: http://dictionary.reference.com/browse/acoustic.*

International Search Report and Written Opinion, PCT/US2010/044753, Nov. 1, 2010, Rolls-Royce Corporation.

* cited by examiner

*Primary Examiner* — George Wyszomierski
*Assistant Examiner* — Tima M McGuthry Banks
(74) *Attorney, Agent, or Firm* — Krieg DeVault LLP

(57) ABSTRACT

Embodiments of the present invention include methods and systems for leaching material from an object. Examples include leaching ceramic from metallic components. Other embodiments include apparatuses, systems, devices, hardware, methods, and combinations for leaching systems. Further embodiments, forms, features, aspects, benefits, and advantages of the present application shall become apparent from the description and figures provided herewith.

13 Claims, 4 Drawing Sheets

SYSTEMS AND METHODS FOR LEACHING A MATERIAL FROM AN OBJECT

CROSS REFERENCE TO RELATED APPLICATIONS

The present application claims the benefit of U.S. Provisional Patent Application No. 61/231,827, filed Aug. 6, 2009, and is incorporated herein by reference.

FIELD OF THE INVENTION

The present invention relates to material removal processing, and more particularly, to methods and systems for leaching a material from an object.

BACKGROUND

Systems that effectively leach materials from objects, such as ceramic from metallic castings in a gas turbine engine, remain an area of interest. Some existing systems have various shortcomings, drawbacks, and disadvantages relative to certain applications. Accordingly, there remains a need for further contributions in this area of technology.

SUMMARY

Embodiments of the present invention include methods and systems for leaching material from an object. Examples include leaching ceramic from metallic components. Other embodiments include apparatuses, systems, devices, hardware, methods, and combinations for leaching systems. Further embodiments, forms, features, aspects, benefits, and advantages of the present application shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
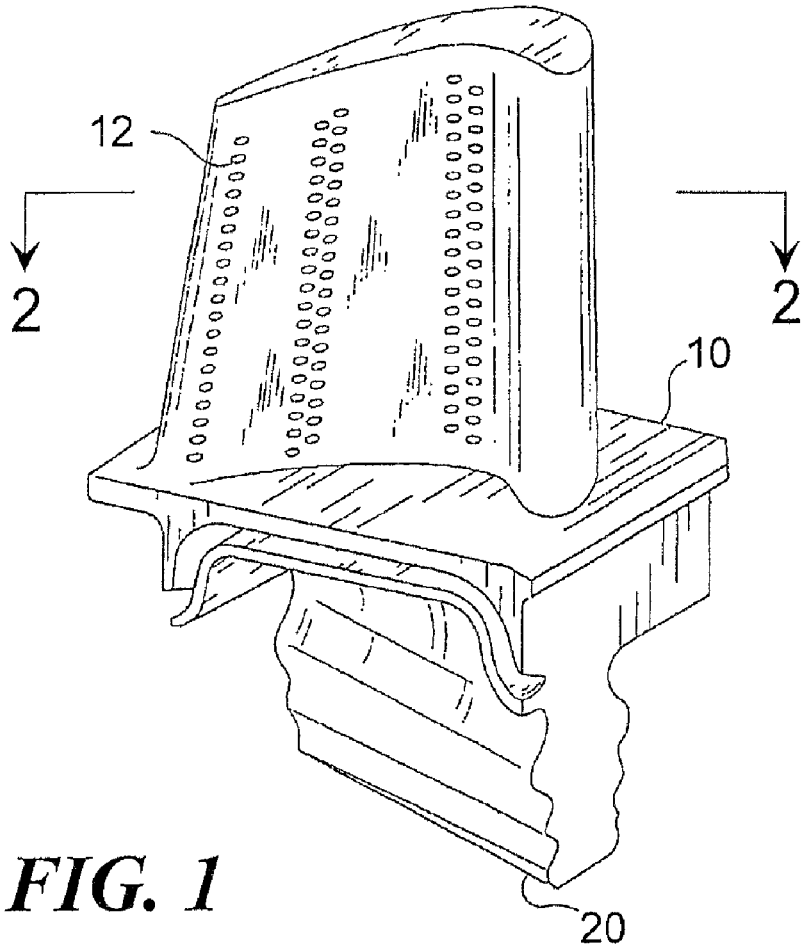
FIG. 1 illustrates an object in the form of a gas turbine engine blade casting in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment (s) are contemplated as being within the scope of the present invention. Further, any other applications of the principles of the invention, as illustrated and/or described herein, as would normally occur to one skilled in the art to which the invention pertains, are contemplated as being within the scope of the present invention.

Figure 2:
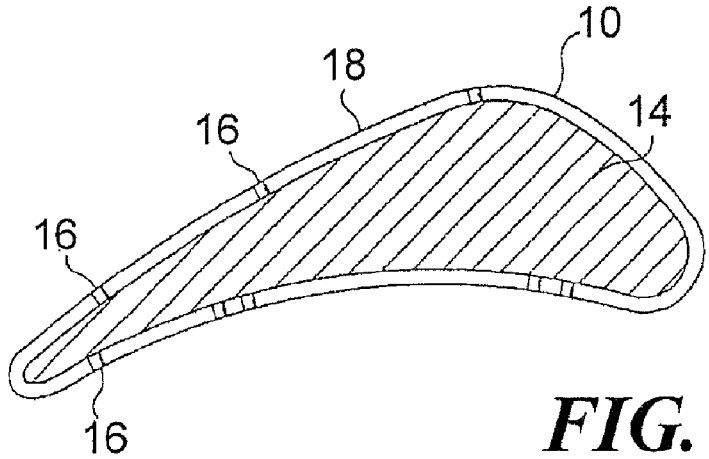
FIG. 2 is a cross section of the object of the embodiment of FIG. 1 illustrating a material in the form of a ceramic core that may be removed by leaching.
Figure 3:
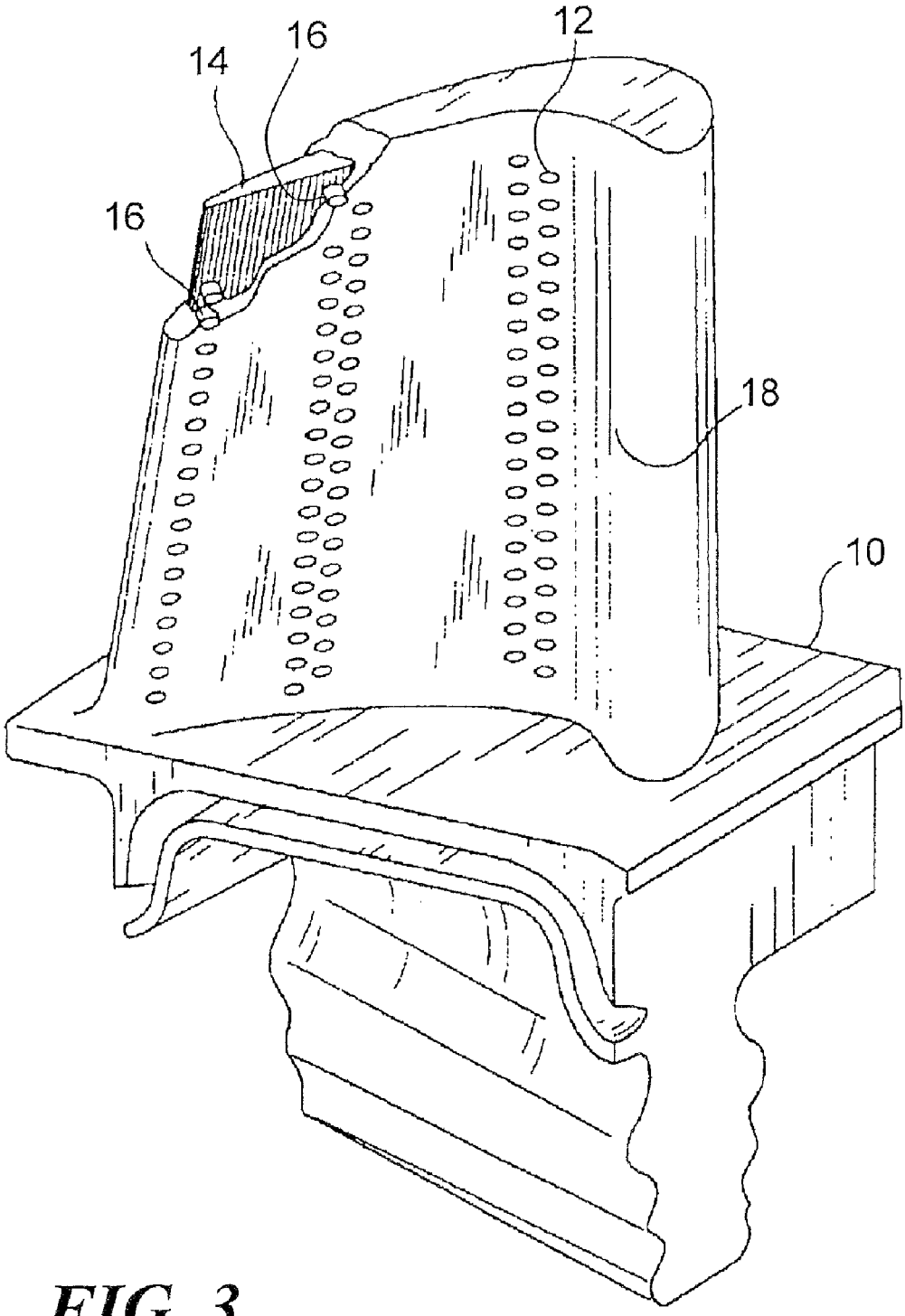
FIG. 3 depicts a cutaway view gas turbine engine blade casting of the embodiment of FIG. 1 illustrating portions of the ceramic core.

Referring now to the drawings, and in particular FIGS. 1-3, there is illustrated a non-limiting example of an object. In one form, the object is a cast metallic component. In one particular form, the cast metallic component is a cooled gas turbine engine blade casting 10 having an internal cooling system (not illustrated) and a plurality of cooling air discharge apertures 12. Although described herein as a cast gas turbine engine blade, it will be understood that the present invention is equally applicable to other types of objects 10, formed by casting processes and/or other processes. The types of components that can be processed with forms of the present invention include virtually all fields and can be made of a great variety of materials and crystal configurations. The components can be formed of metallic and/or inter-metallic materials and have crystal structures and/or orientations consistent with single crystal, directionally solidified, and/or equiax. Gas turbine engine component designers are particularly interested in nickel and cobalt alloys and superalloys. However, all types of materials including, but not limited to, metallic and inter-metallic materials are contemplated herein.

Casting 10 includes internal passageways and openings defined by a separate material, that is, a material different than that which forms casting 10. In one form, the material is a ceramic core 14. In other embodiments, other materials may be used, both internal and external to the casting 10. In one form, core 14 includes protrusions 16 that extend through to the outer surface 18 of casting 10 and define apertures 12. In one form, core 14 is exposed the environment external to casting 10 via apertures 12. Core 14 is also exposed to the external environment via an opening (not shown) in the bottom surface 20 of casting 10. The ceramic cores and/or ceramic material utilized to form internal passageways and/or openings in casting 10 can be provided in a variety of ways including, but not limited to, integral, individual and/or mechanically coupled. Materials contemplated for ceramic cores include all ceramic materials and mixtures thereof that are removable with a leaching agent. Ceramic materials contemplated herein include, but are not limited to, alumina, zirconia, silica, yttria, magnesia, and mixtures thereof.

Aspects of the present invention include systems and methods for leaching the material (e.g., ceramic core 14) from casting 10. However, it will be understood that the present invention is applicable to the removal of ceramic material and/or ceramic cores from a great variety of types of components and is not limited to gas turbine engine castings or components. While the embodiments of present invention are described herein with reference to a gas turbine engine blade it should be understood that the process is equally applicable to virtually any type of casting, as well as to components/objects that are formed by means other than casting.

Figure 4:
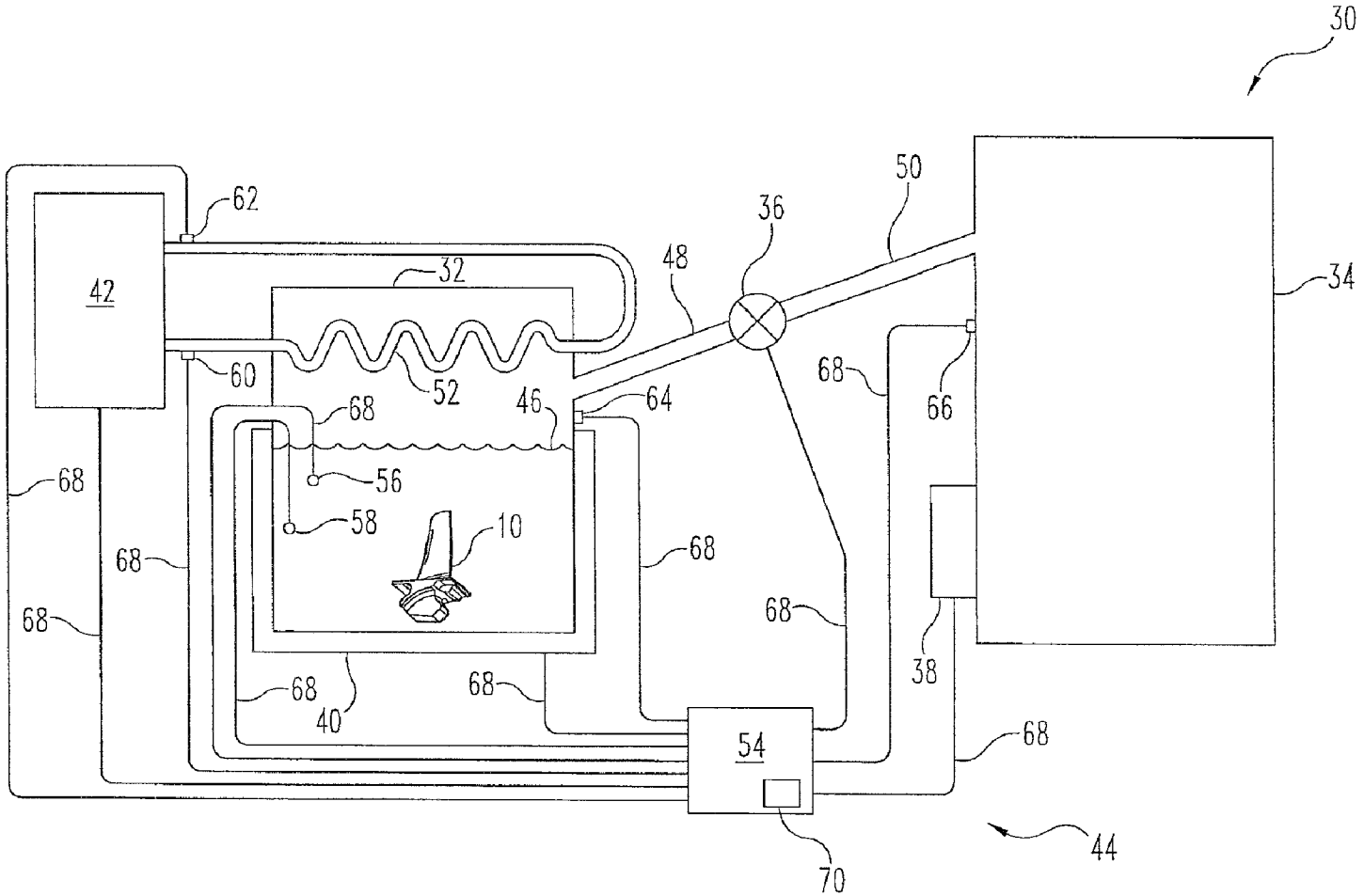
FIG. 4 schematically illustrates a system for leaching a material from an object in accordance with an embodiment of the present invention.

Referring now to FIG. 4, a non-limiting example of a system 30 for leaching ceramic core 14 from casting 10 in accordance with an embodiment of the present invention is schematically illustrated. The present invention is applicable for the removal of ceramic material and casting cores of any density. It will be understood that at least one form of the present invention contemplates the removal of the ceramic casting material and/or ceramic casting cores from casting 10 without any substantial deterioration and/or attack to casting 10.

In one form, system 30 includes a vessel 32, an accumulator 34, a valve 36, a pressure reducing device 38, a heater 40, a cooling system 42 and a control system 44. Vessel 32 is structured to contain casting 10 with core 14 disposed within a bath of liquid leaching agent 46 at and above atmospheric pressure. Core 14 is exposed to leaching agent 46 as set forth above, e.g., via apertures 12. In one form, various components of system 30 are configured for automatic operation under the direction of control system 44. In other embodiments system 30 may have greater or lesser degrees of automation, or may not have any automation. In one form, system 30 is operative to boil the leaching agent in order to increase the rate at which core 14 is leached from casting 10.

Vessel 32, accumulator 34, valve 36, pressure reducing device 38, heater 40, cooling system 42 and other components within the ceramic material leaching system 30 are formed of materials selected to withstand degradation from leaching agent 46. In one form of the present invention, vessel 32 and system 30 components in fluid communication with leaching agent 46 are nickel-based materials. It will be understood that other materials may be employed in other embodiments.

In one form of the present invention, vessel 32 is a pressure vessel. In one form, vessel 32 is about eighteen inches in diameter and twenty inches deep and is formed of nickel. In other embodiments, vessel 32 may be of any size in accordance with the needs of the particular application, and may formed of any material or combination of suitable materials, e.g., materials capable of withstanding exposure to the leaching agent at the desired pressures and temperatures. While the Figures herein illustrate the processing of one casting 10 at a time, it will be understood that a plurality of castings 10 can be placed within vessel 32 to facilitate bulk processing. Whether the parts can be stacked on top of the other or require the use of racks in vessel 32 will be determined based upon the geometry and properties of the individual castings 10.

Vessel 32 contains a sufficient quantity of leaching agent 46 to fill the vessel 32 to a suitable level, the closed vessel 32 forming all or a portion of a closed system. In one form, leaching agent 46 is one or more aqueous alkali hydroxides. In a particular example, the leaching material has the formula MOH, where M is selected from the group consisting of lithium, sodium, potassium, rubidium and cesium. In a more particular example, the leaching material is KOH or NaOH. In one embodiment of the present invention the leaching material is about 82.3 wt % KOH and the balance is water. However, the present invention contemplates other concentrations and types of leaching materials including, but not limited to, alkaline, acidic or solvents.

Accumulator 34 is in fluid communication with vessel 32 via a fluid line 48, valve 36 and a fluid line 50. Fluid lines 48 and 50 are operative to transfer leaching agent 46 vapor from vessel 32 to accumulator 34. In one form, fluid lines 48 and 50 are formed of nickel-based steel tubing. In other embodiments, fluid lines 48 and 50 may take any convenient form, including, for example, fluid passages in vessel 32 and accumulator 34, pipes, flexible hoses, etc., and may be formed of any suitable material or combination of materials. Accumulator 34 is configured to serve as a pressure sink for vessel 32 for reducing pressure in vessel 32 by exposing vessel 32 to lower pressures in accumulator 34. In one form, accumulator 34 is a vacuum reservoir configured to hold a partial or full vacuum. In other embodiments, accumulator 34 may be configured to hold a vacuum and/or pressures above atmospheric.

Valve 36 is in fluid communication with vessel 32 and with accumulator 34, and is operative to control the fluidic exposure of vessel 32 to accumulator 34. Valve 36 has an open position to vent vessel 32 to accumulator 34. In the open position, vessel 32 is exposed to the lower pressure of accumulator 34 to superheat and boil heated leaching agent 46 in vessel 32. Valve 36 has a closed position to fluidly isolate vessel 32 from accumulator 34. In one form, valve 36 is an electrically actuated valve that is automatically controlled by control system 44.

Pressure reducing device 38 is in fluid communication with accumulator 34. Pressure reducing device 38 is structured to reduce the pressure in accumulator 34. In particular, pressure reducing device 38 is structured to reduce the pressure in accumulator 34 to a desired pressure that is less than the pressure in vessel 32 in order to superheat and boil heated leaching agent 46 within vessel 32. In one form, pressure reducing device 38 is a pump. In a particular example, pressure reducing device 38 is a vacuum pump. In one form, pressure reducing device 38 is structured to evacuate accumulator 34 to a desired pressure (vacuum) level. In other embodiments, other types of pressure reducing devices may be employed, for example and without limitation, such as a valve structured to vent accumulator 34 to a lower pressure sink or an ejector, such as a steam ejector.

Although one embodiment of the present application employs accumulator 34, valve 36 and pressure reducing device 38 to reduce the pressure in vessel 32 to superheat and boil heated leaching agent 46 within vessel 32, other embodiments may employ other means for reducing the pressure in vessel 32 to superheat and boil heated leaching agent 46 within vessel 32. For example and without limitation, some embodiments may include a piston/cylinder, diaphragm and/or bellows arrangement in fluid communication with vessel 32, wherein the piston/cylinder, diaphragm and/or bellows arrangement may be employed to draw down on vessel 32 to reduce the pressure in vessel 32.

Heater 40 is structured to heat leaching agent 46. In one form of the present invention the heater 40 is a strap resistance heater that provides the required heating energy to vessel 32. However, the present invention contemplates a variety of heaters including, but not limited to, molten metal bath heaters, resistant heaters, radiant quartz heaters, induction heaters and flame heaters. The present invention contemplates a heater having the capacity to heat the vessel 32, leaching agent 46 and casting 10 to predetermined temperatures in specified times, which may vary with the needs of the particular application.

Cooling system 42 is structured to condense into a liquid the leaching agent 46 vapor that is produced by boiling leaching agent 46 during the operation of system 30. In one form, cooling system 42 includes a cooling loop 52 located in the headspace above the liquid leaching agent 46 inside vessel 32. In one form, cooling loop 52 circulates a coolant inside vessel 32, such as water, to condense the leaching agent 46 vapor. Other arrangements for condensing leaching agent 46 vapor are contemplated in other embodiments.

Control system 44 includes a controller 54 and one or more sensors that are structured to sense a control parameter associated with the boiling of leaching agent 46. Controller 54 is communicatively coupled to pressure reducing device 38, and is operative to control pressure reducing device 38 based on an output from one or more sensors. Controller 54 is configured to execute program instructions to vary the pressure in accumulator 34 using pressure reducing device 38 based on the sensed control parameter, in order to control the amount of boiling of leaching agent 46. In one form, controller 54 is a proportional integral derivative (PID) controller. Other types of controllers may be employed in other embodiments. In one form, controller 54 is a microprocessor based, and the program instructions are in the form of software stored in a memory (not shown). However, it is alternatively contemplated that the controller and program instructions may be in the form of any combination of software, firmware and hardware, including state machines, and may reflect the output of discreet devices and/or integrated circuits, which may be co-located at a particular location or distributed across more than one location, including any digital and/or analog devices configured to achieve the same or similar results as a processor-based controller executing software or firmware based instructions.

In one form, the operation of system 30 includes exposing core 14 to liquid leaching agent 46 in vessel 32, and heating leaching agent 46 using heater 40. In one form, core 14 is exposed to leaching agent 46 by submerging casting 10 in the bath of leaching agent 46 inside vessel 32. The temperature to which leaching agent 46 is heated depends upon various factors, such as the type and concentration of leaching agent 46, the material used to form core 14, the pressure within vessel 32 and the material used to form casting 10. In one example, leaching agent 46 is heated to approximately 220° C. In a particular example, leaching agent 46 is heated to approximately 250° C. During the heating of leaching agent 46, vessel 32 is isolated from accumulator 34 by valve 36, e.g., under the direction of controller 54. In some embodiments, vessel 32 includes a pressure relief valve that vents excess pressure in vessel 32, e.g., to accumulator 34 or another pressure sink. Because vessel 32 is a closed system, the pressure inside vessel 32 increases with the heating of leaching agent 46. In some embodiments, the pressure in vessel 32 may be further increased, e.g., using a pressure source external to vessel 32.

Prior to or during the heating and pressurization of leaching agent 46 in vessel 32, the pressure in accumulator 34 is reduced to a pressure less than that in vessel 32 having the heated leaching agent 46. The pressure in accumulator 34 is set to a value that will superheat leaching agent 46 under selected temperature conditions inside vessel 32 by venting vessel 32 to accumulator 34. The reduced pressure set point value for accumulator 34 may vary, for example, with system loading, leaching agent 46 type and concentration, the operating pressure and temperature of vessel 32 with leaching agent 46 in the heated condition, and/or leaching agent 46 depletion resulting from reaction with core 14. Leaching agent 46 is considered to be superheated when its pressure is reduced to a value lower than that required for thermodynamic equilibrium, such that the temperature of the liquid leaching agent 46 is higher than the boiling point of the liquid leaching agent 46. The pressure in accumulator 34 may vary with the application. In one form, the pressure in accumulator 34 is determined by pressure differential relative to the pressure in vessel 32. Although described herein as being less than atmospheric pressure, it will be understood that in some embodiments, accumulator 34 may be at a pressure greater than or equal to atmospheric.

After leaching agent 46 is heated to the desired temperature and the pressure in accumulator 34 is at the desired value, a boiling cycle is performed. Valve 36 is opened to vent vessel 32 to the lower pressure of accumulator 34. Exposure of the contents of vessel 32 to the lower pressure of accumulator 34 superheats the liquid leaching agent 46, causing the liquid leaching agent 46 to boil.

Figure 5:
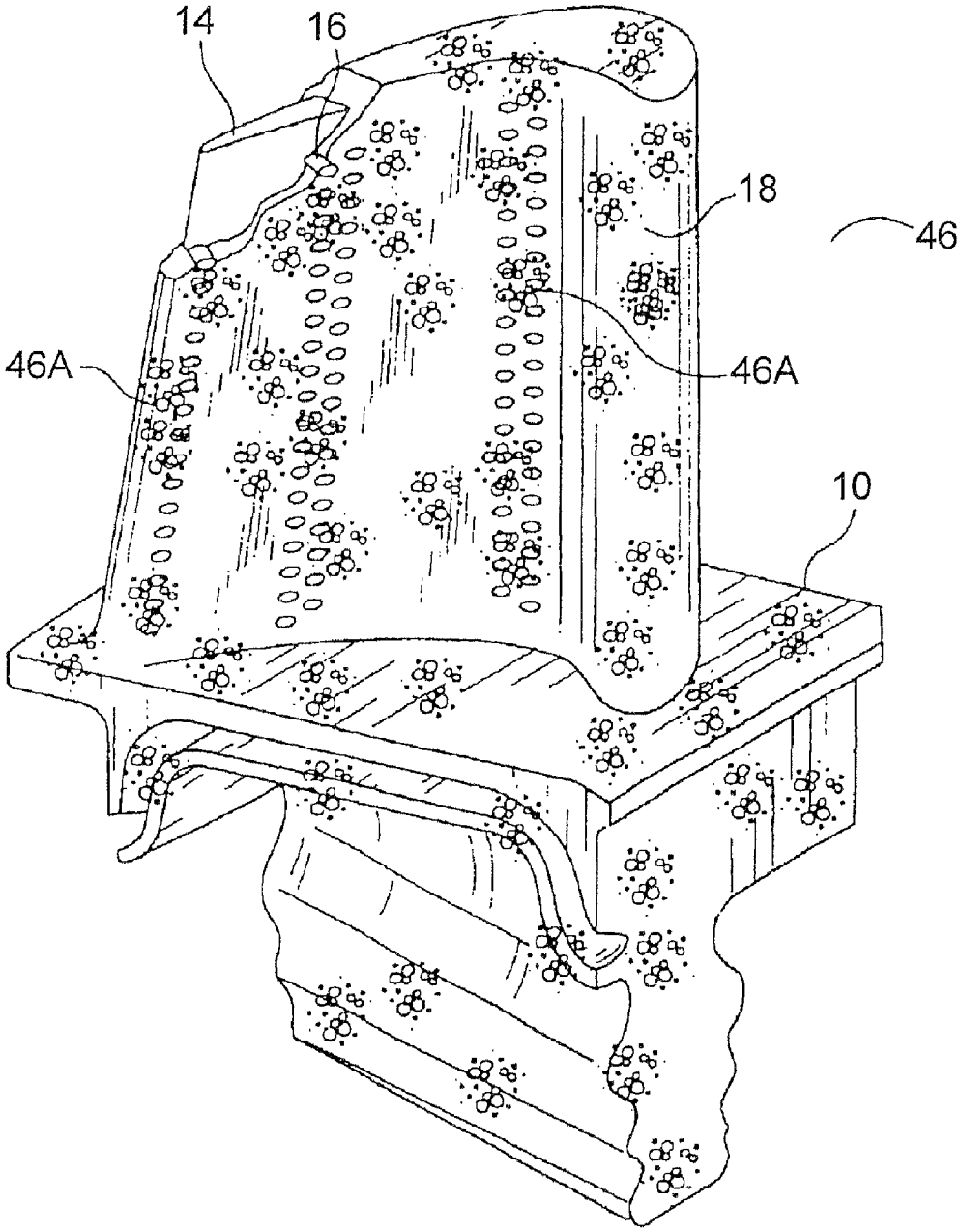
FIG. 5 illustrates the gas turbine engine blade casting of the embodiment of FIG. 1 immersed in a superheated boiling leaching agent in accordance with an aspect of the present invention.

Referring now to FIG. 5, casting 10 with core 14 is depicted as being submerged in a superheated boiling leaching agent 46. It will be understood that FIG. 5 illustrates a transient condition during the process of leaching core 14 from casting 10, wherein the superheated leaching agent 46 is causing the nucleation of boiling bubbles 46A all over the internal and external surfaces of casting 10 and core 14 that are disposed in contact with leaching agent 46. Boiling bubbles 46A form along the inner and outer surfaces of the cast component 10 and on core 14 and protrusions 16 that are in fluid communication with the leaching agent 46.

The plurality of boiling bubbles 46A creates areas of local agitation and fluid movement to displace the liquid leaching agent 46 at the bubble nucleation site and refill the area with other liquid leaching agent 46. The agitation serves to replenish leaching agent 46 in the vicinity of casting 10 and core 14. For example, it is recognized that during the core 14 removal process, there is often leaching agent 46 adjacent to core 14 that is at least partially depleted (due to it reacting with core 14) in comparison with the bulk leaching material in the vessel. This partially depleted leaching agent 46 is often present at the core 14—leaching agent 46 interface. The presence of this at least partially depleted leaching agent 46 at the core 14—leaching agent 46 interface slows the process of removing core 14 from the casting 10. The boiling bubbles 46A function to drive the at least partially depleted leaching agent 46 from the core-leaching interface and facilitate replacement with other leaching agent 46.

Referring again to FIG. 4, in one aspect of the present invention, the amount of boiling of leaching agent 46 is controlled, e.g., to enhance the efficiency of the process of removing core 14 from casting 10. In one form system 30 maintains a constant degree of agitation (resulting from boiling leaching agent 46) during each boiling cycle, regardless of varying system conditions, such as variation in leaching agent 46 concentration and depletion of leaching agent 46 that may occur during the leaching process. As set forth herein, in one form, the constant degree of agitation is obtained by controlling the boiling of leaching agent 46. In other embodiments, the degree of agitation may be varied, e.g., as between boiling cycles. In still other embodiments, the degree of agitation may vary throughout a given boiling cycle, e.g., by varying the amount of boiling in a given boiling cycle, which may be achieved, for example, by varying the flow area through which vessel 32 is vented to accumulator 34.

It is recognized that the boiling action of leaching agent 46 is the means by which the superheated leaching agent 46 reduces its energy. As such, the boiling leaching agent 46 is undergoing a cooling process. The cooling occurs, in part, as a result of vapor formation within the fluid, which is a volumetric reaction. Thus, the degree of agitation produced by the nucleation of the leaching agent 46 is related to the degree of cooling experienced by the liquid leaching agent 46. Given a constant initial pressure (e.g., the pressure in vessel 32 after heating leaching agent 46, but before venting vessel 32 to accumulator 34), for a given temperature drop of the liquid leaching agent 46 resulting from the boiling of the superheated liquid leaching agent 46, the amount of vapor formed during the boiling process is relatively constant. As such, for a given temperature drop, the degree of agitation per unit volume of leaching agent 46 is also relatively constant. Thus, by controlling the temperature drop of the liquid leaching agent 46 that results from the boiling of the superheated liquid leaching agent 46, the volumetric amount of boiling may be controlled.

In one form, control system 44 controls the amount of boiling of leaching agent 46 by controlling the temperature drop within the liquid leaching agent 46 that occurs as a result of the superheated boiling of the leaching agent 46. In a particular form, the temperature control is accomplished by varying the pressure or degree of vacuum in accumulator 34 prior to equalization with vessel 32 via valve 36 and fluid lines 48, 50, which may be referred to herein as the pre-boiling cycle pressure. In one form, the boiling is terminated after equalization at a desired point by re-pressurizing vessel 32. In some embodiments, the temperature may be controlled by varying the flow area through which vessel 32 is vented to accumulator 34. In other embodiments, the temperature may be controlled by other means, including by adding heat to leaching agent 46 during the boiling process while venting vessel 32 to accumulator 34.

In order to control the amount of boiling, embodiments of control system 44 include one or more sensors. The sensor(s) provide feedback information associated with the boiling of leaching agent 46, which is used as a control parameter. Embodiments of the present invention sense one or more control parameters associated with the boiling of leaching agent 46, which is used by controller 54 to vary the pressure in accumulator 34 to control the amount of boiling. In one form, the control parameters are sensed prior to, during and/or after the previous boiling cycle, and are used to determine the pressure in accumulator 34 for a subsequent boiling cycle. In one form, the pressure in accumulator 34 is varied to control the duration of the boiling cycle. For example, the greater the pressure differential between vessel 32 and accumulator 34 prior to a boiling cycle, the greater the degree of superheat of leaching agent 46 upon the venting of vessel 32 to accumulator 34. Under otherwise similar conditions, a greater superheat results in a longer duration of boiling, as well as a more virulent boil. The process of heating leaching agent 46, reducing the pressure in accumulator 34, performing a boiling cycle, sensing control parameters and varying the pre-boiling cycle pressure in accumulator 34 is repeated until core 14 has been leached from casting 10 completely, or to a desired degree.

Illustrated in FIG. 4 are exemplary sensors, including a temperature sensor 56, a nucleation sensor 58, a temperature sensor 60, a temperature sensor 62, a pressure sensor 64 and a pressure sensor 66, which are each communicatively coupled to controller 54 via a communications link 68. Valve 36, pressure reducing device 38, heater 40 and cooling system 42 are also each communicatively coupled to controller 54 via a communications link 68. The operations of valve 36, pressure reducing device 38, heater 40 and cooling system 42 are each directed by controller 54 via the respective communications links 68. In one form, communications link 68 is a wired connection. Other types of communications links are contemplated in other embodiments, including digital and analog links, and wireless links. The type of communications link 68 may vary with the particular sensor or other component that is coupled thereby with controller 54. Embodiments of the present invention include one or more of sensors 56, 58, 60, 62, 64 and 66, as described herein.

In one form, control system 44 includes temperature sensor 56 and pressure sensor 66. Temperature sensor 56 is operative to sense the temperature of the liquid leaching agent 46. In particular, sensor 56 is operative to sense the temperature drop in boiling superheated leaching agent 46 during the boiling cycle. More particularly, sensor 56 senses the temperature drop in the previous boiling cycle, which is used by controller 54 to set an accumulator 34 initial pressure value for the subsequent boiling cycle, i.e., the pre-boiling cycle pressure. In one form, temperature sensor 56 is disposed within vessel 32, e.g., in the bath of liquid leaching agent 46. In other embodiments, the location of temperature sensor 56 may vary. Temperature sensor 56 provides signals indicative of the temperature drop as feedback to controller 54. Pressure sensor 66 is operative to sense the pressure in accumulator 34. Pressure sensor 66 provides a signal indicative of accumulator 34 pressure as feedback to controller 54.

Controller 54 is configured to execute program instructions to compare the temperature drop in the liquid leaching agent resulting from boiling of the liquid leaching agent 46 with a selected temperature value. In one form, the selected temperature value is a predetermined fixed value. In other form, the selected temperature value is determined by controller 54, e.g., based on other parameters, such as leaching agent 46 concentration or leaching agent 46 depletion parameters. In one form, the temperature drop is a temperature drop in the liquid leaching agent 46 resulting from boiling of the leaching agent in the previous boiling cycle. That is, in one form, the sensed value from one boiling cycle is used to set the accumulator pressure for the next boiling cycle. In one form, controller 54 is configured to execute program instructions increase the pre-boiling cycle pressure in accumulator 34 in response to a temperature drop reaching or exceeding the selected value, and to reduce the pre-boiling cycle pressure in accumulator 34 in response to the temperature drop being less than the selected value.

In another form, control system 44 includes nucleation sensor 58, a timer 70, e.g., a built-in timer in controller 54, and pressure sensor 66. Nucleation sensor 58 is operative to detect nucleation in the boiling leaching agent 46, e.g., the acoustic noise and/or vibrations indicative of boiling of the leaching agent 46. In one form, nucleation sensor 58 is mounted on vessel 32. In other embodiments, the location of nucleation sensor 58 may vary. In one form, nucleation sensor 58 is a microphone. In another form, nucleation sensor 58 is an accelerometer. In other embodiments, other types of nucleation sensors may be employed. Nucleation sensor 58 provides a signal indicative of boiling in leaching agent 46. Controller 54 measures the duration of boiling based the output of nucleation sensor 58. Pressure sensor 66 is operative to sense the pressure in accumulator 34. Pressure sensor 66 provides a signal indicative of accumulator 34 pressure as feedback to controller 54.

Controller 54 is configured to execute program instructions to compare the duration of boiling with a selected value. In one form, the selected duration value is a predetermined fixed value. In other form, the selected duration value is determined by controller 54, e.g., based on other parameters, such as leaching agent 46 concentration or leaching agent 46 depletion parameters. In one form, the sensed boiling duration is the duration of the previous boiling cycle. That is, in one form, the sensed value from one boiling cycle is used to set the accumulator pressure for the next boiling cycle. In one form, controller 54 is configured to execute program instructions increase the pre-boiling cycle pressure in accumulator 34 in response to the duration of boiling in the previous boiling cycle reaching or exceeding the selected value, and to reduce the pre-boiling cycle pressure in accumulator 34 in response to the duration being less than the selected value.

In yet another form, control system 44 includes temperature sensors 60, 62. Temperature sensors 60, 62 are operative to sense the temperature of the coolant of cooling system 42. In particular, sensors 60, 62 are operative to sense the coolant temperature rise in cooling loop 52 that results from cooling loop 52 condensing the leaching agent 46 vapor generated by boiling the liquid leaching agent 46. More particularly, sensors 60, 62 sense the temperature rise in the previous boiling cycle, which is used by controller 54 to set an accumulator 34 initial pressure value for the subsequent boiling cycle, i.e., the pre-boiling cycle pressure. In one form, temperature sensors 60, 62 are disposed along cooling loop 52. In other embodiments, the locations of temperature sensors 60, 62 may vary. Temperature sensors 60, 62 provide signals indicative of the temperature rise as feedback to controller 54. Pressure sensor 66 is operative to sense the pressure in accumulator 34. Pressure sensor 66 provides a signal indicative of accumulator 34 pressure as feedback to controller 54.

Controller 54 is configured to execute program instructions to compare the coolant temperature rise with a selected temperature rise value. In one form, the selected temperature rise value is a predetermined fixed value. In other form, the selected temperature rise value is determined by controller 54, e.g., based on other parameters, such as leaching agent 46 concentration or leaching agent 46 depletion parameters. In one form, the temperature rise is the coolant temperature rise in the previous boiling cycle. That is, in one form, the sensed value from one boiling cycle is used to set the accumulator pressure for the next boiling cycle. In one form, controller 54 is configured to execute program instructions increase the pre-boiling cycle pressure in accumulator 34 in response to a temperature rise reaching or exceeding the selected value, and to reduce the pre-boiling cycle pressure in accumulator 34 in response to the temperature rise being less than the selected value.

In still another form, control system 44 includes pressure sensor 64. Pressure sensor 64 is operative to sense the pressure in vessel 32. In particular, pressure sensor 64 is operative to sense the pressure increase that results from boiling the liquid leaching agent 46. More particularly, pressure sensor 64 senses the pressure increase in the previous boiling cycle, which is used by controller 54 to set an accumulator 34 initial pressure value for the subsequent boiling cycle, i.e., the pre-boiling cycle pressure. In one form, pressure sensor 64 is in fluid communication with vessel 32. In one form, pressure sensor 64 is disposed in vessel 32. In other embodiments, the location of pressure sensor 64 may vary. Pressure sensor 64 provides signals indicative of the pressure increase as feedback to controller 54. Pressure sensor 66 is operative to sense the pressure in accumulator 34. Pressure sensor 66 provides a signal indicative of accumulator 34 pressure as feedback to controller 54.

Controller 54 is configured to execute program instructions to compare the pressure increase with a selected pressure increase value. In one form, the selected pressure increase value is a predetermined fixed value. In other form, the selected pressure increase value is determined by controller 54, e.g., based on other parameters, such as leaching agent 46 concentration or leaching agent 46 depletion parameters. In one form, the pressure increase is a pressure increase in the previous boiling cycle. That is, in one form, the sensed value from one boiling cycle is used to set the accumulator pressure for the next boiling cycle. In one form, controller 54 is configured to execute program instructions increase the pre-boiling cycle pressure in accumulator 34 in response to a pressure increase reaching or exceeding the selected value, and to reduce the pre-boiling cycle pressure in accumulator 34 in response to the pressure increase being less than the selected value.

In yet still another form, controller 54 determines the amount of energy required to reheat leaching agent 46 in vessel 32 up to a desired temperature subsequent to the previous boiling cycle. That is, in one form, the sensed value from one boiling cycle is used to set the accumulator pressure for the next boiling cycle. In one form, controller 54 includes timer 70, and calculates the amount of energy based on the power supplied to heater 40 and the amount of time the power is supplied. In other embodiments, the amount of energy required to reheat leaching agent 46 may be determined via other means. Pressure sensor 66 is operative to sense the pressure in accumulator 34. Pressure sensor 66 provides a signal indicative of accumulator 34 pressure as feedback to controller 54.

Controller 54 is configured to execute program instructions to compare the amount of energy required to re-heat the leaching agent with a selected value. In one form, the selected energy value is a predetermined fixed value. In other form, the selected energy value is determined by controller 54, e.g., based on other parameters, such as leaching agent 46 concentration or leaching agent 46 depletion parameters. In one form, controller 54 is configured to execute program instructions increase the pre-boiling cycle pressure in accumulator 34 in response to the amount of energy reaching or exceeding the selected value, and to reduce the pre-boiling cycle pressure in accumulator 34 in response to the amount of energy being less than the selected value.

Embodiments of the present invention include a method for leaching a material from an object, comprising: exposing the material to a liquid leaching agent in a vessel; heating the leaching agent; reducing a first pressure in an accumulator to less than a second pressure in the vessel with the heated leaching agent; performing a boiling cycle by venting the vessel to the accumulator to superheat and boil the leaching agent; sensing a control parameter associated with boiling of the leaching agent; and varying the first pressure in the accumulator based on the sensed control parameter to control an amount of boiling of the leaching agent.

In a refinement, the first pressure is varied based on sensing the control parameter during a previous boiling cycle.

In another refinement, the first pressure is varied to control a duration of boiling.

In yet another refinement, the embodiment further comprises repeating the heating the leaching agent, the reducing the first pressure in the accumulator and the performing the boiling cycle until the material is leached from the object.

In still another refinement, the object is a metallic cast component, and wherein the material is a ceramic core.

In yet still another refinement, the control parameter is a temperature of the liquid leaching agent.

In a further refinement, the temperature is a temperature drop in the liquid leaching agent resulting from boiling of the leaching agent in a previous boiling cycle.

In a yet further refinement, the method further comprises reducing the first pressure in the accumulator in response to the temperature drop being less than or equal to a selected value.

In a still further refinement, the control parameter is a plurality of control parameters, including an acoustic noise indicative of boiling of the leaching agent and including a duration of boiling determined based on the acoustic noise.

In a yet still further refinement, the method further comprises reducing the first pressure in the accumulator in response to the duration of boiling in a previous boiling cycle being less than or equal to a selected value.

In an additional refinement, the boiling leaching agent produces a leaching agent vapor, further comprising using a coolant to condense the leaching agent vapor into liquid form, wherein the control parameter is a temperature rise of the coolant resulting from condensing the leaching agent vapor.

In another additional refinement, the method further comprises reducing the first pressure in the accumulator in response to the temperature rise of the coolant being less than or equal to a selected value.

In yet another additional refinement, the control parameter is a pressure in the vessel.

In still another additional refinement, the pressure is a pressure increase resulting from superheated boiling of the leaching agent.

In yet still another additional refinement, the method further comprises reducing the first pressure in the accumulator in response to the pressure increase in a previous boiling cycle being less than or equal to a selected value.

In another further refinement, the control parameter is an amount of energy required to re-heat the leaching agent subsequent to a previous boiling cycle, further comprising reducing the first pressure in the accumulator in response to the amount of energy being less than or equal to a selected value.

In yet another further refinement, the method further comprises re-pressurizing the vessel to terminate the boiling.

Embodiments of the present invention also include a system for leaching a material from an object, comprising: a pressure vessel structured to contain the object with the material exposed to a liquid leaching agent; a heater structured to heat the leaching agent; an accumulator; a valve in fluid communication with the pressure vessel and the accumulator, wherein the valve has an open position to vent the pressure vessel to the accumulator to superheat and boil the leaching agent in the vessel, and wherein the valve has a closed position to fluidly isolate the pressure vessel from the accumulator; a pressure reducing device in fluid communication with the accumulator, wherein the pressure reducing device is structured to reduce pressure in the accumulator to a first pressure less than a second pressure in the pressure vessel; a sensor structured to sense a control parameter associated with boiling of the leaching agent; and a controller communicatively coupled to the pressure reducing device and the sensor and operative to control the pressure reducing device based on an output from the sensor, wherein the controller is configured to execute program instructions to vary the first pressure in the accumulator based on the sensed control parameter to control an amount of boiling of the leaching agent.

In a refinement, the sensor is a temperature sensor operative to sense a temperature of the liquid leaching agent; and the controller is configured to execute program instructions to increase the first pressure in the accumulator in response to a temperature drop resulting from boiling the liquid leaching agent reaching or exceeding a selected value.

In another refinement, the sensor is a plurality of sensors including a nucleation sensor and a timer; the control parameter is a plurality of control parameters, including acoustic noise indicative of boiling of the leaching agent and including a duration of boiling determined based on the acoustic noise; and the controller is configured to execute program instructions to increase the first pressure in the accumulator in response to the duration of boiling in a previous boiling cycle reaching or exceeding a selected value.

In yet another refinement, wherein the boiling leaching agent produces a leaching agent vapor, the method further comprises: a cooling system structured to condense the leaching agent vapor using a coolant, wherein: the sensor is a temperature sensor operative to sense a temperature of the coolant; the control parameter is a temperature rise of the coolant resulting from condensing the leaching agent vapor; and the controller is configured to execute program instructions to increase the first pressure in the accumulator in response to the temperature rise of the coolant reaching or exceeding a selected value.

In still another refinement, the sensor is a pressure sensor operative to sense the pressure in the pressure vessel; the control parameter is a pressure increase resulting from superheated boiling of the leaching agent; and the controller is configured to increase the first pressure in the accumulator in response to the pressure increase in a previous boiling cycle reaching or exceeding a selected value.

In yet still another refinement, the control parameter is an amount of energy required to re-heat the leaching agent subsequent to a previous boiling cycle; and the controller is configured to increase the first pressure in the accumulator in response to the amount of energy reaching or exceeding a selected value.

In a further refinement, in the pressure reducing device is a pump.

Embodiments of the present invention also include a system for leaching a material from an object, comprising: means for containing the object and a liquid leaching agent; means for heating the leaching agent; means for reducing pressure in the means for containing to superheat and boil the leaching agent; means for varying pressure in the means for reducing pressure based on a control parameter associated with boiling of the leaching agent to control an amount of boiling of the leaching agent.

In a refinement, the means for varying pressure includes means for comparing a temperature drop in the liquid leaching agent resulting from boiling of the liquid leaching agent with a selected value.

In another refinement, the means for varying pressure includes means for comparing a duration of boiling with a selected value.

In yet another refinement, the system further comprises means for condensing a leaching agent vapor using a coolant, wherein the means for varying pressure includes means for comparing a temperature increase of the coolant with a selected value.

In still another refinement, the means for varying pressure includes means for comparing a pressure increase resulting from superheated boiling of the leaching agent with a selected value.

In yet still another refinement, the means for varying pressure includes means for comparing an amount of energy required to re-heat the leaching agent with a selected value.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A system for leaching a material from an object, comprising:

a pressure vessel structured to contain said object with said material exposed to a liquid leaching agent;

a heater structured to heat the leaching agent;

an accumulator;

a valve in fluid communication with said pressure vessel and said accumulator, wherein said valve has an open position to vent said pressure vessel to said accumulator to superheat and boil the leaching agent in said vessel, and wherein said valve has a closed position to fluidly isolate said pressure vessel from said accumulator;

a pressure reducing device in fluid communication with said accumulator, wherein said pressure reducing device is structured to reduce pressure in said accumulator to a first pressure less than a second pressure in said pressure vessel, wherein the first pressure is a pre-boiling pressure in said accumulator;

a sensor structured to sense a control parameter associated with boiling of the leaching agent; and a controller communicatively coupled to said pressure reducing device and said sensor and operative to control said pressure reducing device based on an output from said sensor, wherein said controller is configured to execute program instructions to vary the first pressure in the accumulator based on the sensed control parameter to control an amount of boiling of the leaching agent.

2. The system of claim 1, wherein:

said sensor is a temperature sensor operative to sense a temperature of the liquid leaching agent; and said controller is configured to execute program instructions to increase the first pressure in the accumulator in response to a temperature drop resulting from boiling the liquid leaching agent reaching or exceeding a selected value.

3. The system of claim 1, wherein:

said sensor is a plurality of sensors including a nucleation sensor and a timer;

the control parameter is a plurality of control parameters, including acoustic noise indicative of boiling of the leaching agent and including a duration of boiling determined based on the acoustic noise; and said controller is configured to execute program instructions to increase the first pressure in the accumulator in response to the duration of boiling in a previous boiling cycle reaching or exceeding a selected value.

4. The system of claim 1, wherein the boiling leaching agent produces a leaching agent vapor, further comprising:

a cooling system structured to condense the leaching agent vapor using a coolant, wherein:

said sensor is a temperature sensor operative to sense a temperature of the coolant;

the control parameter is a temperature rise of the coolant resulting from condensing the leaching agent vapor; and said controller is configured to execute program instructions to increase the first pressure in the accumulator in response to the temperature rise of the coolant reaching or exceeding a selected value.

5. The system of claim 1, wherein:

said sensor is a pressure sensor operative to sense the pressure in the pressure vessel;

the control parameter is a pressure increase resulting from superheated boiling of the leaching agent; and said controller is configured to increase the first pressure in the accumulator in response to the pressure increase in a previous boiling cycle reaching or exceeding a selected value.

6. The system of claim 1, wherein:

the control parameter is an amount of energy required to re-heat the leaching agent subsequent to a previous boiling cycle; and said controller is configured to increase the first pressure in the accumulator in response to the amount of energy reaching or exceeding a selected value.

7. The system of claim 1, wherein said pressure reducing device is a pump.

8. A system for leaching a material from an object, comprising:

means for containing the object and a liquid leaching agent;

means for heating the leaching agent;

means for reducing pressure in the means for containing to superheat and boil the leaching agent;

means for varying a pre-boiling pressure in the means for reducing pressure, by varying the pre-boiling temperature in an accumulator, based on a control parameter associated with boiling of the leaching agent to control an amount of boiling of the leaching agent.

9. The system of claim 8, wherein said means for varying pressure includes means for comparing a temperature drop in the liquid leaching agent resulting from boiling of the liquid leaching agent with a selected value.

10. The system of claim 8, wherein said means for varying pressure includes means for comparing a duration of boiling with a selected value.

11. The system of claim 8, further comprising means for condensing a leaching agent vapor using a coolant, wherein said means for varying pressure includes means for comparing a temperature increase of the coolant with a selected value.

12. The system of claim 8, wherein said means for varying pressure includes means for comparing a pressure increase resulting from superheated boiling of the leaching agent with a selected value.

13. The system of claim 8, wherein said means for varying pressure includes means for comparing an amount of energy required to re-heat the leaching agent with a selected value.

* * * * *